United States Patent [19]

Bonner

[11] 4,121,758

[45] Oct. 24, 1978

[54] MAILBOX LINER WITH MAIL REMOVAL SLIDE

[76] Inventor: Emerson Bonner, 413 S. Elm, Lusk, Wyo. 82225

[21] Appl. No.: 771,368

[22] Filed: Feb. 23, 1977

[51] Int. Cl.[2] ..... B65D 91/00

[52] U.S. Cl. ..... 232/17; 232/24; 232/33

[58] Field of Search ..... 232/16, 17, 24, 25, 232/33, 34, 35, 38; 312/274, 342, 344, 345

[56] References Cited

U.S. PATENT DOCUMENTS

| | | | |
|---|---|---|---|
| 252,154 | 1/1882 | Temple et al. | 232/24 |
| 958,203 | 5/1910 | Weiss | 312/345 |
| 1,220,251 | 3/1917 | Martin | 232/33 |
| 1,299,740 | 4/1919 | Larson | 232/35 |
| 2,781,964 | 2/1957 | Ledgerwood | 232/17 |
| 2,868,444 | 1/1959 | Whittier | 232/33 X |

*Primary Examiner*—Roy D. Frazier
*Assistant Examiner*—Peter A. Aschenbrenner
*Attorney, Agent, or Firm*—Clarence A. O'Brien; Harvey B. Jacobson

[57] ABSTRACT

The invention provides apparatus for facilitating the removal of mail from a mailbox, particularly the relatively small individual mailbox units which comprise large banks or clusters of such units in post offices, apartment buildings, office buildings, and the like. In one basic embodiment of the invention, a movable bar-like slide disposed within the confines of the mailbox unit is fitted with a handle at the anterior end thereof so that the slide may be readily grasped and withdrawn from the mailbox unit. A lateral bar-like scoop member formed on the posterior end of the slide engages mail in the mailbox unit and withdraws the mail from the unit on forward movement of the slide. In a preferred embodiment of the invention, the movable slide is disposed on the floor of a box-like insert or liner which is fitted into the mailbox unit, the movable slide being adapted to move within a groove formed in said floor.

9 Claims, 4 Drawing Figures

MAILBOX LINER WITH MAIL REMOVAL SLIDE

BACKGROUND AND SUMMARY OF THE INVENTION

Use of rural and suburban mailboxes of the standard horizontal type stimulated the conception and development of mailbox accessories which enabled the user of the mailbox to withdraw mail from said box with increased ease. These prior art accessories have typically been slidably mounted within the mailbox and have included mechanical linkages operatively connecting the slidable accessory to the door of the box so that the same would move outwardly as the door opened. These prior art mailbox accessories have met with limited acceptance due not only to the general complexity thereof but also to the fact that the standard rural mailbox is of a size relative both to the usual types of mail and to the hand of a user that difficulty in removing mail from such boxes is not typically encountered. The following U.S. patents disclose typical developments in this field: U.S. Pat. Nos:

741,489 — Oct. 13, 1903 — Hamilton, et al.
1,139,491 — May 18, 1915 — Coon
1,471,899 — Oct. 23, 1923 — Koenig
1,879,200 — Sep. 27, 1932 — Grimm
2,781,964 — Feb. 19, 1957 — Ledgerwood
2,868,444 — Jan. 13, 1959 — Whittier
3,163,356 — Dec. 29, 1964 — Joehnk
3,606,140 — Sep. 20, 1971 — Shannahan.

However, in recent years, the proliferation of clusters or banks of relatively smaller "post office box" sized mail receptacles has rendered more common the real problem facing users of such mail receptacles of extraction of mail from such receptacles. Space limitations in post offices, apartment buildings, commercial office buildings, and the like, have resulted in the use of individual mail receptacles which are much smaller volumetrically than the standard rural mailbox. Further, these smaller mail receptacles have openings through which the mail is extracted which are smaller relative to the usual types of mail and smaller relative to the size of the hand. Therefore, extraction of mail from such mail receptacles, especially for individuals suffering from arthritis or similar debilitating condition, is extremely difficult and at times impossibe. Such receptacles with which the invention is particularly useful often have an access opening area of less than 20 square inches.

The present invention provides apparatus useful with mailbox units of all types, but particularly with the relatively small mailbox receptacles which comprise the clusters or banks of mailbox units commonly encountered in urban and suburban living and working situations. In particular, the present invention can preferably take the form of a mailbox insert or liner which is fitted into the individual receptacle, the exterior walls of the liner fitting flushly to the interior walls of the receptacle. The floor of the liner is grooved longitudinally and receives within said groove a bar-like slide having a handle member formed on the anterior end and a lateral bar-like scoop member formed on the posterior end thereof. The handle member is adapted to be grasped by a user at the opening of the receptacle and pulled outwardly from the receptacle, the slide moving outwardly from the receptacle to withdraw mail disposed therein. The scoop member formed on the posterior end of the slide can be configured in various shapes to provide a desired surface area for engagement with rearward portions or the pieces of mail. In those receptacle clusters wherein mail or other items are loaded into the receptacles from the rear thereof, such as in post offices, and the like, the scoop member formed on the slide could not be provided with a laterally extending ledge or "scooping surface" which extended upwardly more than a minor fraction of the distance between the floor and roof of the receptacle. Otherwise, mail could not easily be inserted into the receptacle from the rear thereof. However, when the mail receptacles are to be loaded from the front thereof, the "scooping surface" of the scoop member can extend any desired distance between the floor and roof of the receptacle and can substantially cover the full sectional area of said receptacle to provide more positive engagement with the mail in the receptacle.

Accordingly, it is a primary object of the invention to provide an insert or liner for a mail receptacle, which liner is fitted with a slide in the floor thereof for withdrawal of mail from the receptacle.

It is another object of the invention to provide a slide apparatus in the floor of a mailbox unit or in the floor of a liner for a mail receptacle, which slide apparatus is adapted to be grasped at the anterior end thereof and is adapted to engage mail pieces at the posterior end thereof for facilitating withdrawal of mail from the mailbox unit.

These together with other objects and advantages which will become subsequently apparent reside in the details of construction and operation as more fully hereinafter described and claimed, reference being had to the accompanying drawings forming a part thereof, wherein like numerals refer to like parts throughout.

DESCRIPTION OF THE PREFERRED EMBODIMENTS

Figure 1:
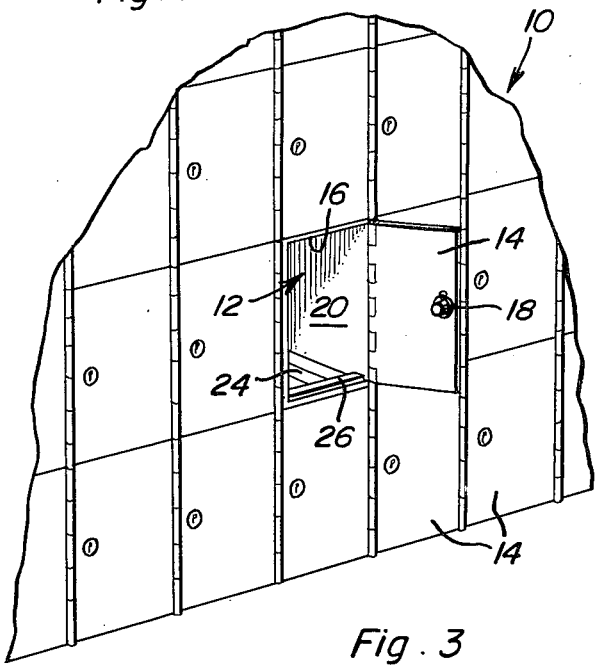
FIG. 1 is a perspective view of a cluster or bank of mail receptacles, one of said receptacles being shown with the closure in the open position to reveal the fitting of the receptacle with the slide apparatus of the present invention.

Referring now to the drawings and in particular to FIG. 1, a cluster 10 of mail receptacles 12 can be seen to provide a high density arrangement for distribution of mail or similar items. Mail can be inserted into the receptacle 12 through either the front or rear of the cluster 10 depending on the particular installation. As anticipated by the structure illustrated, loading of the receptacles 12 with mail can readily be accomplished through the rear of each receptacle 12. Each receptacle 12 is provided with an access door 14 which can be secured over access opening 16 by means of a lock 18. Such structure is standard and can take alternate forms.

In a preferred embodiment of the invention, a liner 20 is inserted into each receptacle 12 (or into selected receptacles 12 depending on the desires of the users thereof), the liner 20 typically being a four-walled box, as shown, which is open at the front and rear thereof. Without departing from the scope and intent of the invention, the liner 20 could be additionally formed with a rear wall (not shown) in which case only that face of the liner 20 which lies in coplanar (or parallel) relationship with the access opening 16 would be open to ambient. A five-walled rectangular solid of this type would not allow insertion of mail into the receptacle 12 from the rear of the receptacle. In certain instances when insertion of mail from the rear of the cluster 10 is not necessary, the additional wall in the rear of the liner 20 can provide additional structural stability. Alternatively, the liner 20 can have the upper face, or roof, thereof absent from the structure.

Figure 2:
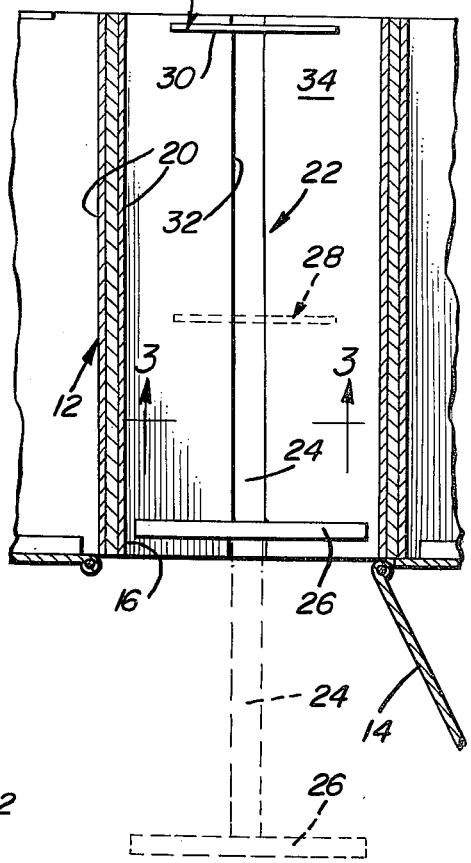
FIG. 2 is a plan view in section of the opened mail receptacle of FIG. 1.
Figure 3:
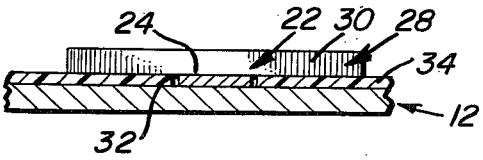
FIG. 3 is a detail end view in section taken along line 3—3 of FIG. 2.
Figure 4:
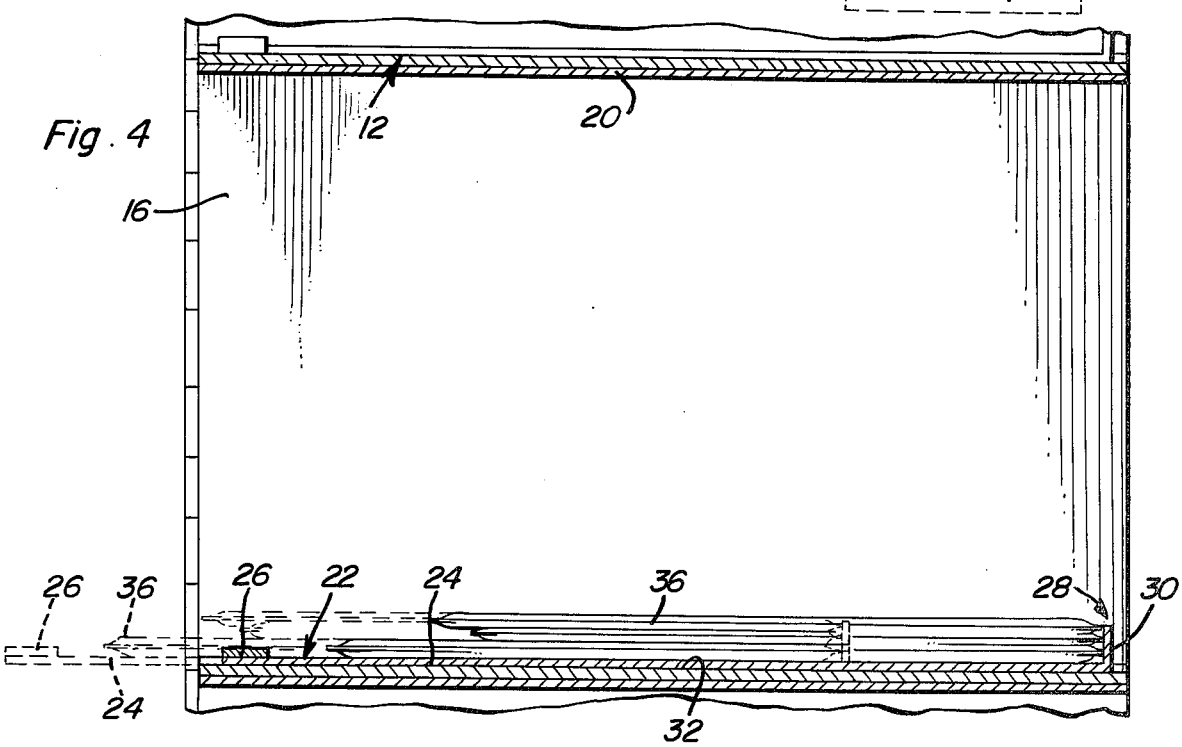
FIG. 4 is an elevational view in section of the mail receptacle of FIG. 1, the slide apparatus being shown in phantom to be partially withdrawn from the receptacle.

As can be partially seen in FIG. 1 and in detail in FIGS. 2–4, a slide assembly 22 is disposed in the lower portion of the receptacle 12, the slide assembly 22 essentially lying on the a floor 34 of the liner 20 in a manner to be further described hereinafter. The slide assembly 22 comprises a bar member 24, a handle member 26, and a scoop member 28. The bar member 24 forms the major body portion of the slide assembly 22, the member 24 having its longitudinal axis disposed substantially parallel to the longitudinal axis of the volumetric space enclosed by the receptacle 12 (or the liner 20). The bar member 24 can be a flat strip of a desired material, such as metal, wood, plastic, or the like. Alternately, the member 24 could be a cylindrical rod or other elongated, relatively rigid structural member sufficient to connect the handle member 26 to the scoop member 28. The handle member 26 can preferably be formed integrally with the anterior end portion of the bar member 24, the handle member 26 taking the form of a horizontally disposed, laterally extending bar. The handle member 26 can obviously be configured as desired to provide a means by which the slide assembly 22 can be grasped by a user and withdrawn outwardly from the receptacle 12 through the access opening 16. The scoop member 28 is similarly attached to or formed integrally with the posterior end of the bar member 24.

The scoop member 28 can preferably be bar-like in conformation, having a longitudinal axis which is oriented horizontally, the ends of the member 28 extending laterally from the posterior end of the bar member 24. The scoop member 28 can be further seen to have a ledge portion 30 which extends upwardly from the plane of the bar member 24. The ledge portion 30 typically is caused to be in a plane normal to the plane of the bar member 24 and parallel to the plane of the access opening 16. The ledge portion 30 in the embodiment shown in FIGS. 3 and 4 extends upwardly only a minor fraction of the distance between the floor 34 of the liner 20 and the roof thereof. Mail can thus be inserted into the receptacle through the rear thereof. However, if mail 36 is to be inserted into the receptacle only through the access opening 16, the ledge portion 30 of the scoop member 28 can extend upwardly through any desired portion of the distance between the floor 34 and the roof of the liner 20 and can extend laterally throughout the full width of the liner 20, as desired. Provision of a larger surface area for the ledge portion 30 of the scoop member 28 allows more positive contact of the scoop member 28 with the mail 36, especially when large mail items or a plurality of stacked mail items are disposed within the receptacle 12.

The slide assembly 22 can be simply disposed on the floor 34 of the liner 20, mail 36 being removed from the receptacle by movement of the assembly 22 forwardly through the access opening 16. The handle member 26 provides a convenient means by which to grasp the slide assembly 22 and exert outwardly directed force thereon. Alternately, as seen in FIGS. 2, 3, and 4, and particularly in FIG. 3, a groove 32 can be longitudinally formed in the floor 34 of the liner 20, the bar member 24 being received within the groove 32. The groove 32 essentially acts as a track in which the slide assembly 22 can be moved within the confines of the receptacle 12. Although not shown, the groove 32 could be provided with perimetric, longitudinal tabs along the upper edges thereof to provide a partially enclosed track to allow the slide assembly 22 to positively follow the track formed by said groove.

Within the scope of the appended claims, it is to be understood that the invention can be practiced other than as specifically shown and described herein. In particular, the liner 20 and slide assembly 22 can be formed of materials such as wood, metal, or plastic, and the like. Further, certain of the structures could be integrally formed through molding techniques, such as are well known in the art.

The foregoing in considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A mail receptacle accessory for facilitating removal of mail or similar items from a mail receptacle having at least one access opening, comprising slidable means disposable in the lower portion of the mail receptacle for engaging mail in the receptacle, the slidable means comprising:

a central support member having its longitudinal axis extending perpendicular to the nominal plane of the access opening;

handle means connected to the anterior end of the support member and adapted to be grasped by a user for withdrawing the slidable means from the interior of the mail receptacle;

scoop means connected to the posterior end of the support member for engaging posterior end portions of mail or similar items disposed in the receptacle and withdrawing said items at least partially from the receptacle on withdrawal of the slidable means at least partially therefrom; and, means for lining the mail receptacle and adapted to be fitted into said receptacle, exterior wall surfaces of the liner means fitting substantially flushly with interior wall surfaces of the mail receptacle, one lower wall portion of the liner means comprising a floor, the floor having a groove formed therein to receive the central support member of the slidable mail engaging means therein, the support member being slidable longitudinally within the groove and forming a portion of said floor.

2. The mail receptacle accessory of claim 1 wherein the central support member comprises an elongated bar member.

3. In combination with a generally horizontally disposed receptacle having an article supporting surface and an access opening associated therewith, a movable member associated with said supporting surface and extending substantially throughout the length thereof and provided with a handle adjacent the access opening and an article engaging portion at the opposite end portion thereof of the movable member to enable the handle to be manually engaged through the access opening and pulled outwardly thereof of the access opening, thereby moving the article engaging portion and articles on the supporting surface toward the access opening, the combination further including a liner adapted to be fitted into the receptacle, a lower wall portion of the liner comprising a floor and having a groove formed therein to receive the movable member therein, the movable member being slidable longitudinally of the receptacle within the groove both toward and away from the access opening and forming a portion or said floor.

4. In the combination of claim 3 wherein exterior wall surfaces of the liner fit substantially flushly with interior wall surfaces of the receptacle.

5. In the combination of claim 4 wherein the receptacle and the liner have aligned rear access openings, the rear access openings being adapted to receive mail into the receptacle therethrough.

6. In the combination of claim 5 wherein the article engaging portion includes a ledge portion which extends laterally from the posterior end of the movable member adjacent the rear access openings and upwardly from the movable member a minor fraction of the distance between the floor of the liner and the top wall surface of the receptacle.

7. The mail receptacle accessory of claim 2 wherein the scoop means include a ledge portion which extends laterally from the posterior end of the bar member and upwardly from the bar member in a plane parallel to the plane of the access opening of the receptacle, the ledge portion engaging portions of the mail or similar items disposed within the receptacle on withdrawal of the slidable means from the receptacle, thereby to also withdraw said items from the receptacle.

8. The mail receptacle accessory of claim 1 wherein the mail receptacle has an access opening which has a projected planar area of less than 20 square inches.

9. The mail receptacle accessory of claim 2 wherein the liner means and the mail receptacle have rear access openings, mail being thereby insertable into the receptacle from the rear thereof, the scoop means including a ledge portion which extends laterally from the posterior end of the bar member and upwardly from the bar member in a plane parallel to the plane of the access opening a minor fraction of the distance between the floor of the liner and the top wall surface of the receptacle.

* * * * *